US010596692B2

(12) United States Patent
Tsai

(10) Patent No.: US 10,596,692 B2
(45) Date of Patent: Mar. 24, 2020

(54) TOOL COMBINATION

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 106 days.

(21) Appl. No.: 15/961,874

(22) Filed: Apr. 25, 2018

(65) Prior Publication Data

US 2019/0329393 A1 Oct. 31, 2019

(51) Int. Cl.

| | |
|---|---|
| ***B25F 1/04*** | (2006.01) |
| ***B25G 1/08*** | (2006.01) |
| ***B25B 13/56*** | (2006.01) |
| ***B25B 15/00*** | (2006.01) |

(52) U.S. Cl.

CPC ..... *B25F 1/04* (2013.01); *B25B 13/56* (2013.01); *B25G 1/085* (2013.01); *B25B 15/005* (2013.01); *B25B 15/007* (2013.01); *B25B 15/008* (2013.01)

(58) Field of Classification Search

CPC ..... B25F 1/04; B25G 1/085; B25B 13/56; B25B 15/005; B25B 15/007; B25B 15/008

USPC ..... 81/440

See application file for complete search history.

(56) References Cited

U.S. PATENT DOCUMENTS

| | | | | |
|---|---|---|---|---|
| 7,467,574 | B1 * | 12/2008 | Lin | B25B 13/461 81/177.85 |
| 8,783,138 | B2 * | 7/2014 | Johnson | B23Q 13/00 81/439 |
| 9,701,005 | B2 * | 7/2017 | Johnson | B25B 15/008 |
| 10,071,469 | B2 * | 9/2018 | Gallegos | B25G 1/085 |

* cited by examiner

*Primary Examiner* — Hadi Shakeri

(57) ABSTRACT

A tool combination includes a body having a left portion, a right portion, a top portion and a bottom portion. The left portion and the right portion are symmetric to each other relative to a vertical plane. The top portion and the bottom portion are symmetric to each other relative to a horizontal plane. The left, right, top and bottom portions respectively includes an identical left, right, top and bottom recess, and an identical left, right, top and bottom spaces. Each of the left, right, top and bottom recesses includes a tool set received therein.

9 Claims, 7 Drawing Sheets

TOOL COMBINATION

BACKGROUND OF THE INVENTION

1. Field of the Invention

The present invention relates to a tool combination, and more particularly, to a tool combination that is able to have more tools to be received therein.

2. Descriptions of Related Art

The conventional tool combination known to applicant is disclosed in U.S. Pat. No. 9,089,960, and includes a housing including a pair of separated and parallel plates. A casing is engaged in the housing and has a compartment formed in the casing and defined by an upper panel and a bottom panel. The upper panel and the bottom panel of the casing are straddled and secured between the plates of the housing. The housing includes a first chamber formed in a first end portion of the housing, and a space formed in an upper portion of the housing and communicating with the first chamber of the housing. An axle is attached to the first end portion of the housing and extended between the plates of the housing and extended through the first chamber of the housing and located outside the casing. A first tool assembly includes a first tool element having a ring member engaged with the axle for pivotally attaching to the housing with the axle and for allowing the first tool element to be selectively pivoted and rotated out of the housing and to be selectively folded and engaged into the first chamber and the space of the housing. A spindle is attached to the upper panel and the bottom panel of the casing and extended through the compartment of the casing and separated from the axle and perpendicular to the upper panel and the bottom panel of the casing and perpendicular to the axle. A second tool assembly includes a first tool member having a ring member engaged with the spindle for pivotally attaching to the casing with the spindle and for allowing the first tool member to be selectively pivoted and rotated out of the casing and to be selectively folded and engaged into the compartment of the casing.

However, there is only three spaces for receiving the tools and may not be sufficient for the users who need more tools carried with them.

The present invention intends to provide a tool combination eliminates the drawbacks mentioned above.

SUMMARY OF THE INVENTION

The present invention relates to a tool combination and comprises a body having a left portion, a right portion, a top portion and a bottom portion. The left portion and the right portion are symmetric to each other relative to a vertical plane. The top portion and the bottom portion are symmetric to each other relative to a horizontal plane. The left, right, top and bottom portions respectively includes an identical left, right, top and bottom recess, and an identical left, right, top and bottom spaces. Each of the left, right, top and bottom recesses includes a tool set received therein.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
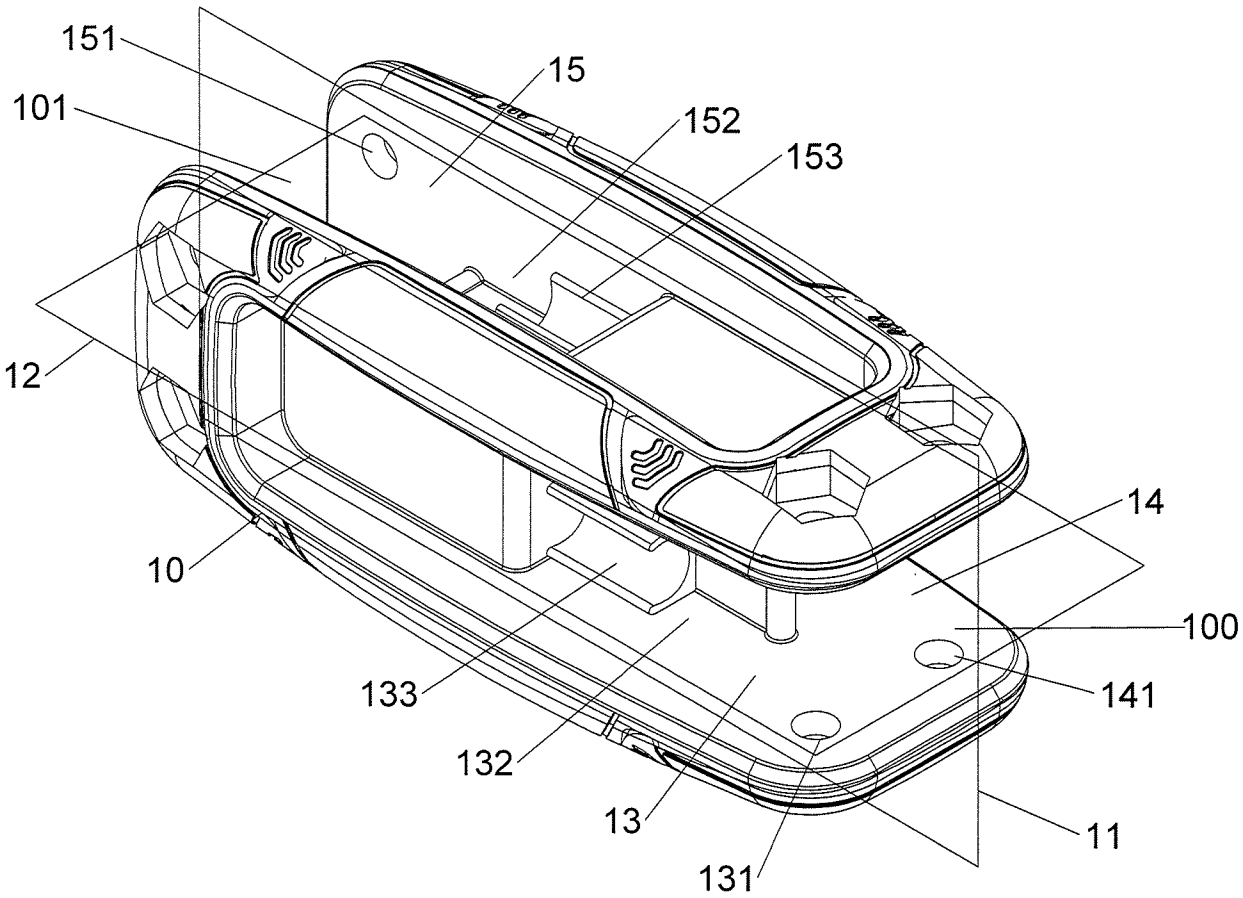
FIG. 1 is a perspective view to show the body of the tool combination of the present invention.
Figure 2:
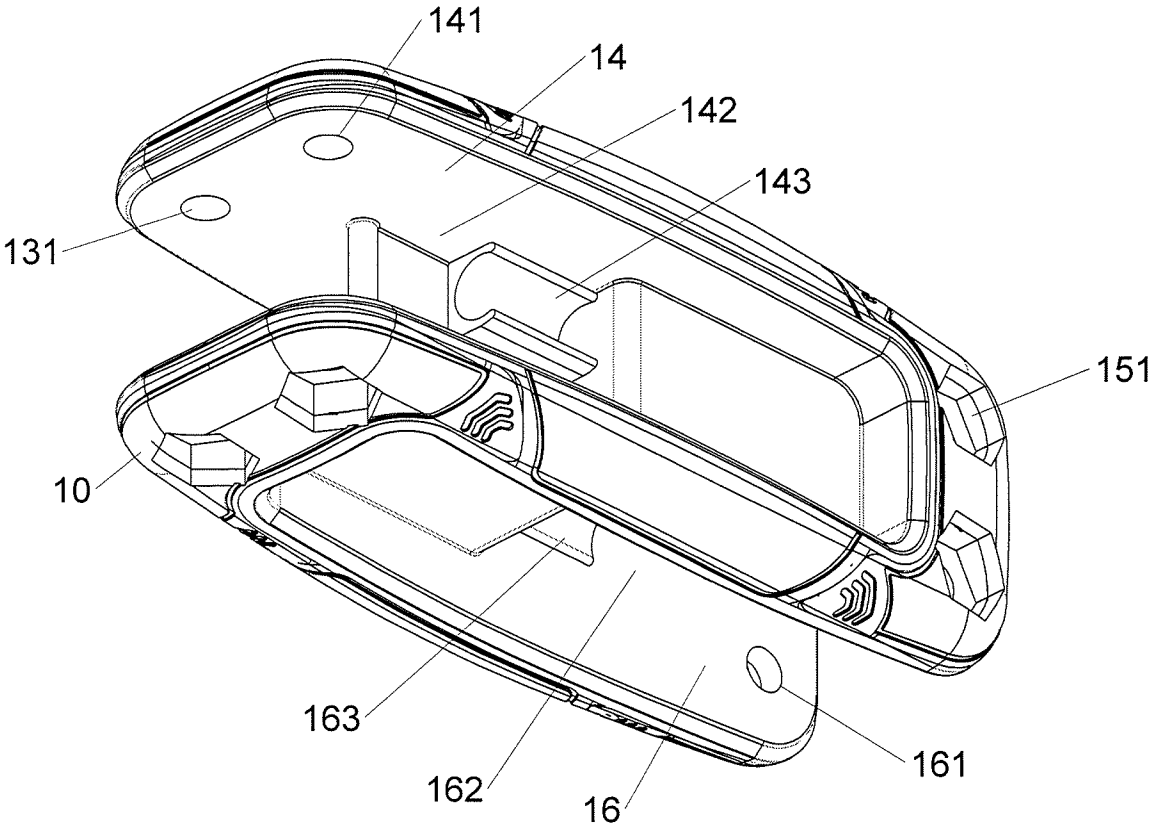
FIG. 2 is another perspective view to show the body of the tool combination of the present invention.
Figure 3:
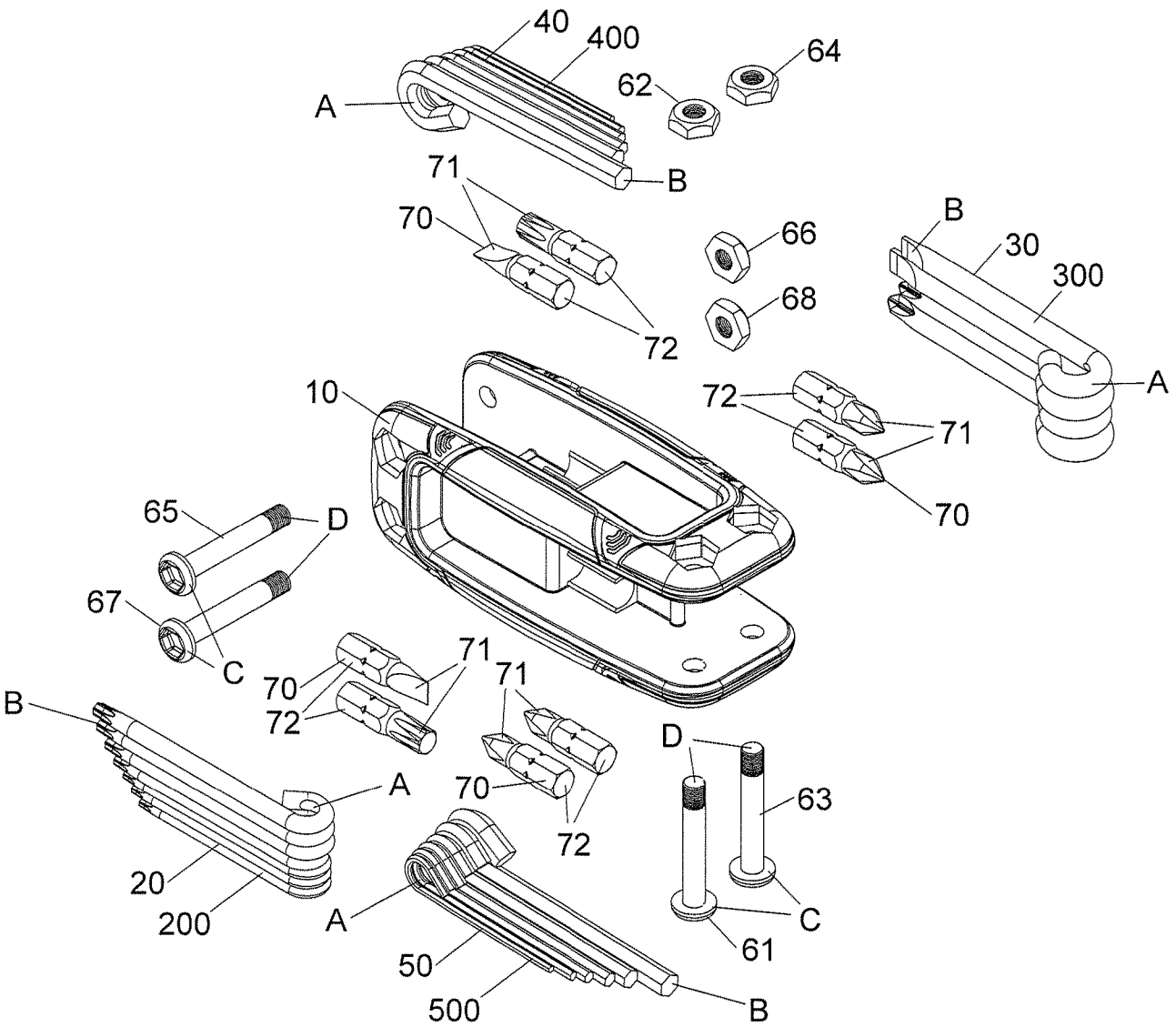
FIG. 3 is an exploded view of the tool combination of the present invention.
Figure 4:
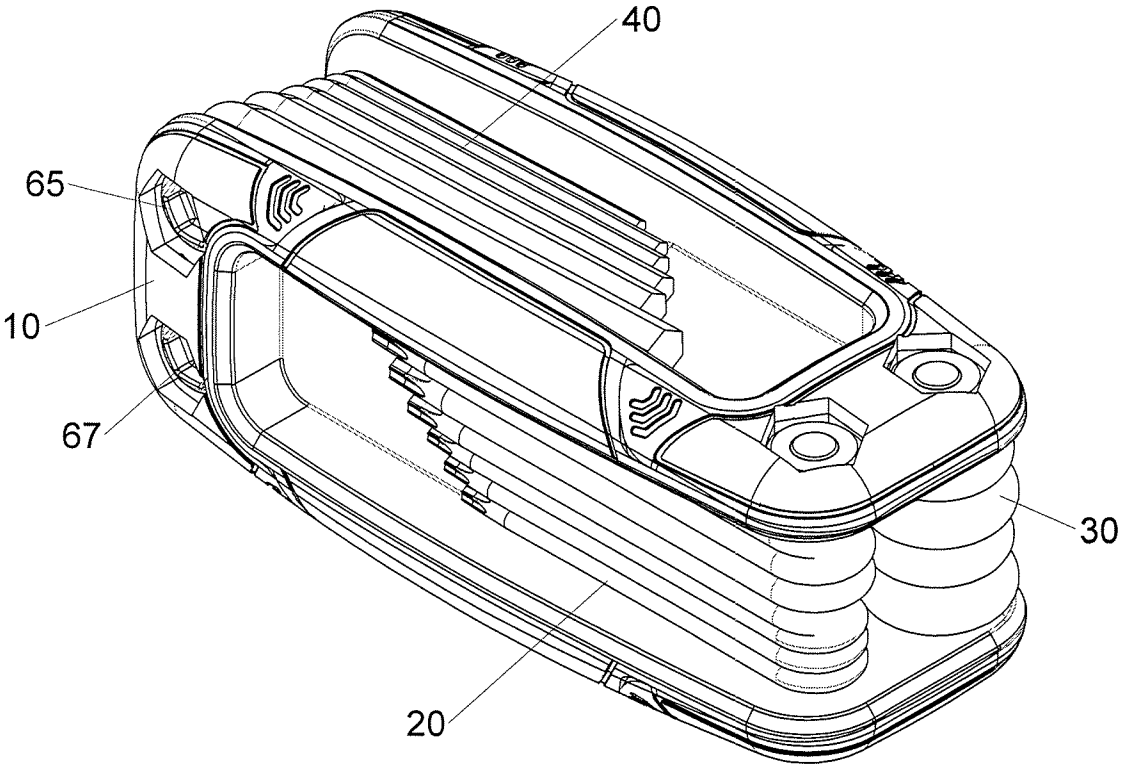
FIG. 4 is a perspective view to show the tool combination of the present invention.
Figure 5:
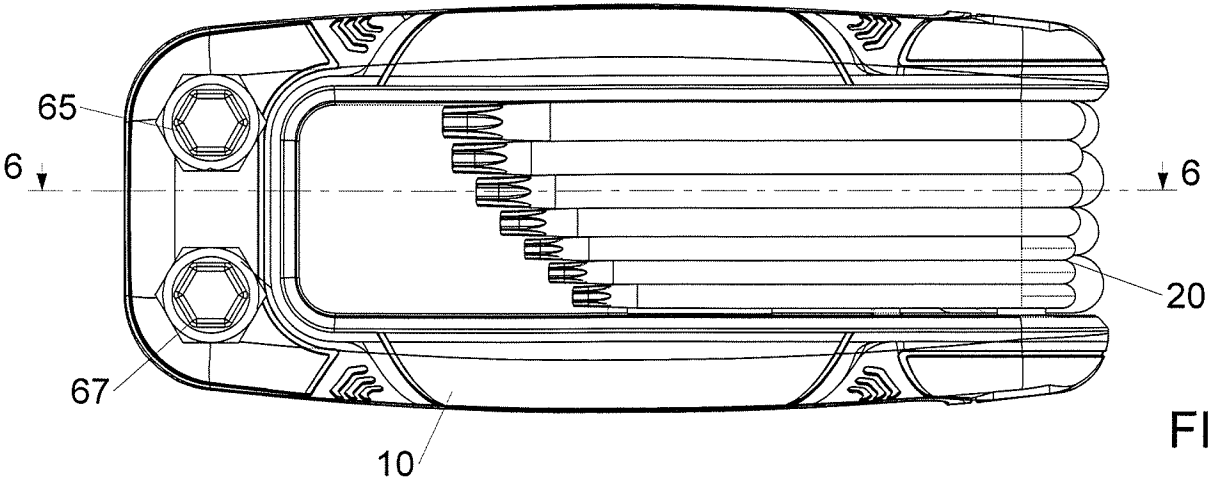
FIG. 5 is a front view of the tool combination of the present invention.
Figure 6:
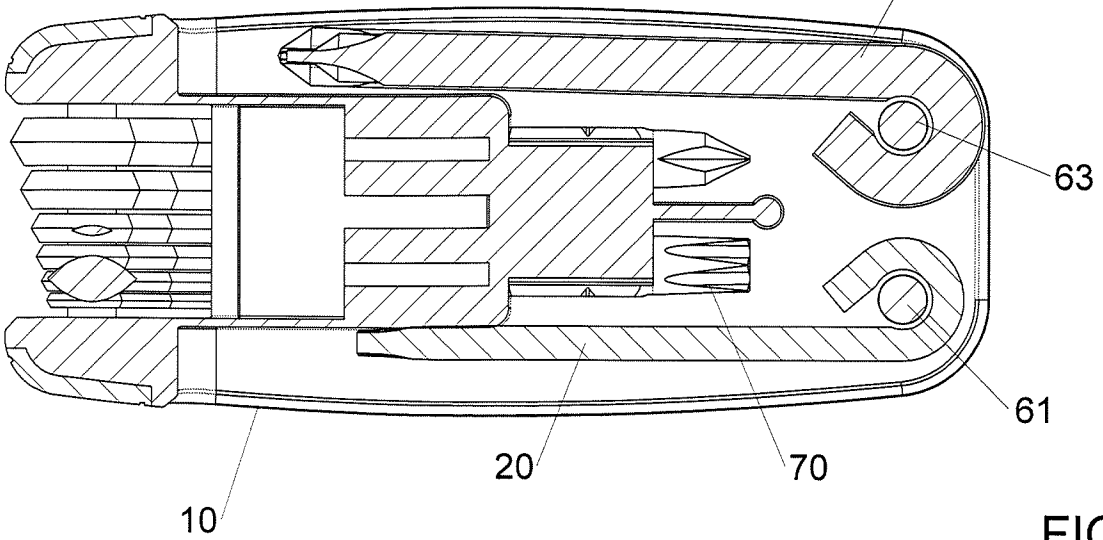
FIG. 6 is an cross sectional view, taken along line 6-6 of FIG. 5.
Figure 7:
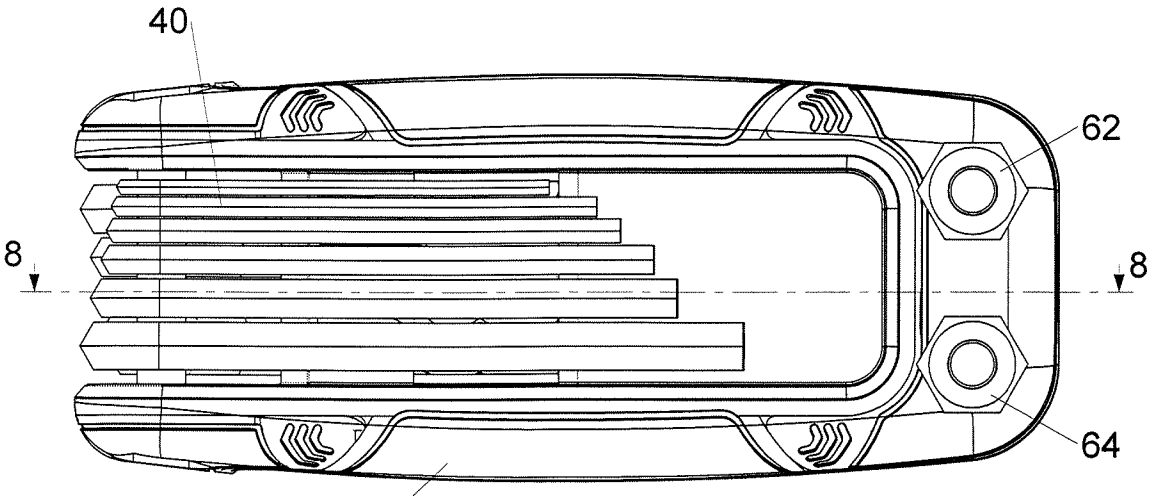
FIG. 7 is a top view of the tool combination of the present invention.
Figure 8:
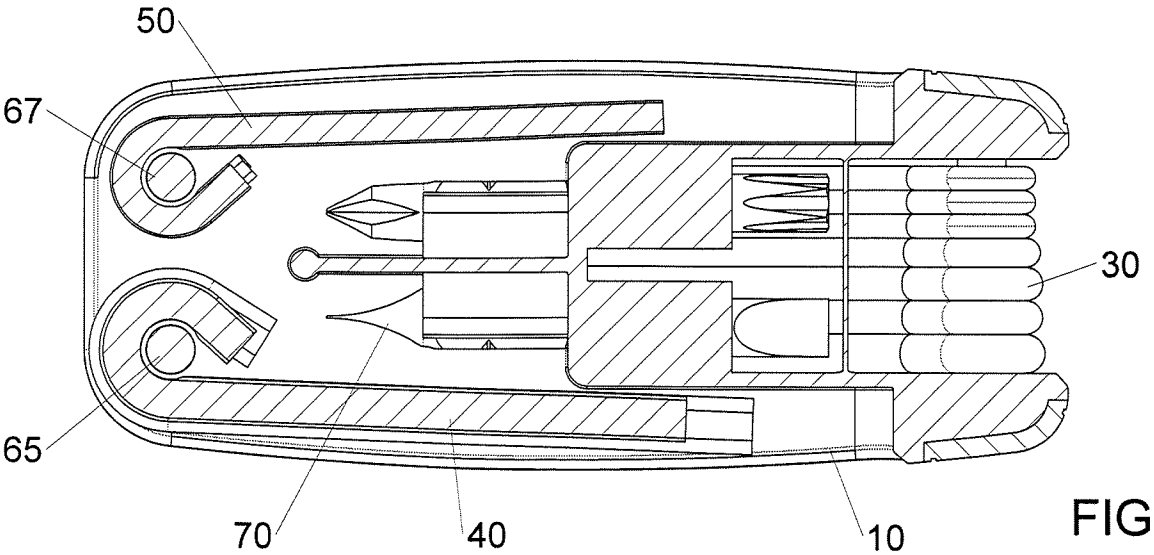
FIG. 8 is an cross sectional view, taken along line 8-8 of FIG. 7.

Referring to FIGS. 1 to 8, the tool combination of the present invention comprises a body 10 which includes a left portion, a right portion, a top portion and a bottom portion. The left portion and the right portion are symmetric to each other relative to a vertical plane 11, and the top portion and the bottom portion are symmetric to each other relative to a horizontal plane 12. The vertical plane 11 intersects the horizontal plane 12 at the axis of the body 10. The left portion and the right portion respectively have a left recess 13 and a right recess 14 which is symmetric to the left recess 13. The rear end of each of the left recess 13 and the right recess 14 is a closed end, and the front end of each of the left recess 13 and the right recess 14 is an open end. The left recess 13 has a left space 132 defined in the front portion thereof, and the right recess 14 has a right space 142 defined in the front portion thereof. The left space 132 is symmetric to the right space 142. The middle portion of the left recess 13 has a left clip groove 133 formed therein, and the middle portion of the right recess 14 has a right clip groove 143 formed therein. Two round left holes 131 are respectively defined through two sidewalls of the front portion of the left recess 13, and two round right holes 141 are respectively defined through two sidewalls of the front portion of the right recess 14. The left space 132 is located between the left clip groove 133 and the left holes 131. The right space 142 is located between the right clip groove 143 and the round right holes 141. The front portion of each of the left recess 13 and the right recess 14 communicate with the front recessed area 100 defined in the front end of the body 10.

The top portion and the bottom portion respectively have a top recess 15 and a bottom recess 16 which is symmetric to the top recess 15. The top recess 15 has a top space 152 defined in the rear portion thereof, and the bottom recess 16 has a bottom space 162 defined in the rear portion thereof. The top space 152 is symmetric to the bottom space 162. The front end of each of the top recess 15 and the bottom recess 16 is a closed end, and the rear end of each of the top recess 15 and the bottom recess 16 is an open end. Two round top holes 151 are respectively defined through two sidewalls of the rear portion of the top recess 15, and two round bottom holes 161 are respectively defined through two sidewalls of the rear portion of the bottom recess 16. The middle portion of the top recess 15 has a top clip groove 153 formed therein, and the middle portion of the bottom recess 16 has a bottom clip groove 163 formed therein. The top space 152 is located between the top clip groove 153 and the round top holes 151. The bottom space 162 is located between the bottom clip groove 163 and the round bottom holes 161. The rear portion of each of the top recess 15 and the bottom recess 16 communicate with the rear recessed area 101 defied in the rear end of the body 10. The left recess 13, the right recess 14, the top recess 15 and the bottom recess 16 are identical, and the left space 132, the right space 142, the top space 152 and the bottom space 162 are identical. The left clip groove 133, the right clip groove 143, the top clip groove 153 and the bottom clip groove 163 is used to clip a handle 72 of a screwdriver bit 70, and a function end 71 of the screwdriver bit 70 is located in one of the left space 132, the right space 142, the top space 152 and the bottom space 162. The handle 72 is located in one of the left clip groove 133, the right clip groove 143, the top clip groove 153 and the bottom clip groove 163. It is noted that there can be two left clip grooves 133, two right clip grooves 143, two top clip grooves 153 and two bottom clip grooves 163 in the body 10.

A first tool set 20 has one end thereof accommodated in the left recess 13 and pivotably mounted to a left pivot 61 which is connected to the left holes 131. A second tool set 30 has one end thereof accommodated in the right recess 14 and pivotably mounted to a right pivot 63 which is connected to the round right holes 141. A third tool set 40 has one end thereof accommodated in the top recess 15 and pivotably mounted to a top pivot 65 which is connected to the top holes 111. A fourth tool set 50 has one end thereof accommodated in the bottom recess 16 and pivotably mounted to a bottom pivot 67 which is connected to the round bottom holes 161. The left pivot 61 and the right pivot 63 are parallel to the vertical plane 11. The top pivot 65 and the bottom pivot 67 are parallel to the horizontal plane 12. The first, second, third and fourth tool sets 20, 30, 40, 50 respectively include first tools 200, second tools 300, third tools 400 and fourth tools 500. Each of the first, second, third and fourth tools 200, 300, 400, 500 includes a first end and a second end which is located opposite to the first end. Each first end has a circled portion "A" through which one of the left pivot 61, the right pivot 63, the top pivot 65 and the bottom pivot 67 extends. Each second end is a function end "B" which is located one of the rear portion of the left recess 13, the rear portion of the right recess 14, the front portion of the top recess 15 and the front portion of the bottom recess 16. The function end "B" of each of the first, second, third and fourth tools 200, 300, 400, 500 can be a screwdriver bit end or a hexagonal end. When the function end "B" of each of the first, second, third and fourth tools 200, 300, 400, 500 is a hexagonal end, each of first, second, third and fourth tools 200, 300, 400, 500 has an identical cross sectional area from first end to second end.

Each of the left, right top and bottom pivots 61, 62, 65 and 67 includes an enlarged head "C" formed to the first end thereof. Each of the left, right top and bottom pivots 61, 62, 65 and 67 includes a threaded end "D" formed to the second end thereof which is connected to a nut 62, 64, 66 or 68 received in the round left, right top and bottom holes 131, 141, 151, 161, such that the left, right top and bottom pivots 61, 62, 65 and 67 are connected to the round left, right top and bottom holes 131, 141, 151, 161.

Figure 9:
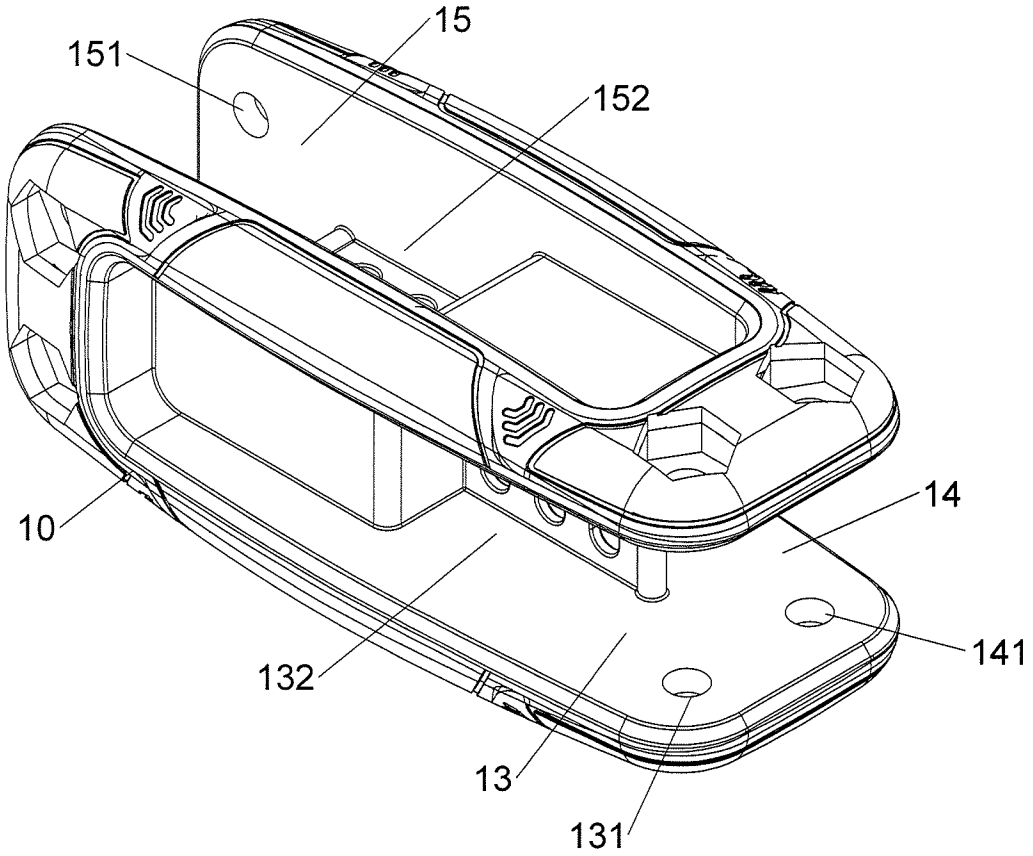
FIG. 9 is another embodiment of show the body of the tool combination of the present invention.

FIG. 9 shows another embodiment, wherein the body 10 does not have the left clip groove 133, the right clip groove 143, the top clip groove 153 and the bottom clip groove 163. Accordingly, no screwdriver bit 70 is received in the body 10.

The advantages of the present invention are that the body 10 includes the left, right, top and bottom recesses 13, 14, 15, 16 to receive more tools therein.

The left, right, top and bottom recesses 13, 14, 15, 16 have identical structure and are respectively symmetric to the vertical plane 11 and the horizontal plane 12. The tool combination has good-looking outer appearance.

The left, right, top and bottom recesses 13, 14, 15, 16 form two U-shaped recesses which are offset from each other, and two U-shaped recesses do not weaken the strength of the body 10.

The symmetric structure of the body 10 is convenient utilized by the users.

The left space 132, the left groove 133, the right space 142, the right clip groove 143, the top space 152, the top clip groove 153, the bottom space 162, and the bottom clip groove 163 clip multiple tools 70.

The body 10 may have different arrangements, that is to say, the body 10 does not have the left clip groove 133, the right clip groove 143, the top clip groove 153 and the bottom clip groove 163.

While we have shown and described the embodiment in accordance with the present invention, it should be clear to those skilled in the art that further embodiments may be made without departing from the scope of the present invention.

What is claimed is:

1. A tool combination comprising:

a body having a left portion and a right portion, the left portion and the right portion being symmetric to each other relative to a vertical plane, the body having a top portion and a bottom portion, the top portion and the bottom portion being symmetric to each other relative to a horizontal plane, the vertical plane intersecting the horizontal plane at an axis of the body;

the left portion and the right portion respectively having a left recess and a right recess which is symmetric to the left recess, the left recess having a left space defined in a front portion thereof, the right recess having a right space defined in a front portion thereof, the left space being symmetric to the right space, two left holes respectively defined through two sidewalls of the front portion of the left recess, two right holes respectively defined through two sidewalls of the front portion of the right recess, the front portion of each of the left recess and the right recess communicating with a front recessed area defined in a front end of the body; wherein a middle portion of the left recess having at least one left clip groove formed therein, a middle portion of the right recess having at least one right clip groove formed therein, and the top portion and the bottom portion respectively having a top recess and a bottom recess which is symmetric to the top recess, the top recess having a top space defined in a rear portion thereof, the bottom recess having a bottom space defined in a rear portion thereof, the top space being symmetric to the bottom space, two top holes respectively defined through two sidewalls of the rear portion of the top recess, two bottom holes respectively defined through two sidewalls of the rear portion of the bottom recess, the rear portion of each of the top recess and the bottom recess communicating with a rear recessed area defied in a rear end of the body, the left recess, the right recess, the top recess and the bottom recess being identical, the left space, the right space, the top space and the bottom space being identical; wherein, a middle portion of the top recess having at least one top clip groove formed therein, a middle portion of the bottom recess having at least one bottom clip groove formed therein; and wherein, the at least one left clip groove, the at least one right clip groove, the at least one top clip groove and the at least one bottom clip groove respectively clipping a handle of at least one screwdriver bit, and the left space, the right space, the top space and the bottom space respectively receiving a function end of the at least one screwdriver bit.

2. The tool combination as claimed in claim 1, wherein the left holes, the right holes, the top holes and the bottom holes each are a round hole.

3. The tool combination as claimed in claim 1, wherein there are two left clip grooves, two right clip grooves, two top clip grooves and two bottom clip grooves.

4. The tool combination as claimed in claim 1, wherein a rear end of each of the left recess and the right recess is a closed end, a front end of each of the left recess and the right recess is an open end, a front end of each of the top recess and the bottom recess is a closed end, a rear end of each of the top recess and the bottom recess is an open end.

5. The tool combination as claimed in claim 1, wherein a first tool set has one end thereof accommodated in the left recess and pivotably mounted to a left pivot which is connected to the left holes, a second tool set has one end thereof accommodated in the right recess and pivotably mounted to a right pivot which is connected to the right holes, a third tool set has one end thereof accommodated in the top recess and pivotably mounted to a top pivot which is connected to the top holes, a fourth tool set has one end thereof accommodated in the bottom recess and pivotably mounted to a bottom pivot which is connected to the bottom holes.

6. The tool combination as claimed in claim 5, wherein the first, second, third and fourth tool sets respectively include first tools, second tools, third tools and fourth tools, each of the first, second, third and fourth tools includes a first end and a second end which is located opposite to the first end, each first end has a circled portion through which one of the left pivot, the right pivot, the top pivot and the bottom pivot extends, each second end is a function end which is located one of a rear portion of the left recess, a rear portion of the right recess, a front portion of the top recess and a front portion of the bottom recess.

7. The tool combination as claimed in claim 5, wherein the function end of each of the first, second, third and fourth tools is a screwdriver bit end or a hexagonal end.

8. The tool combination as claimed in claim 7, wherein when the function end of each of the first, second, third and fourth tools is a hexagonal end, each of first, second, third and fourth tools has an identical cross sectional area from first end to second end.

9. The tool combination as claimed in claim 5, wherein each of the left, right, top and bottom pivots includes an enlarged head formed to a first end thereof, each of the left, right, top and bottom pivots includes a threaded end formed to a second end thereof which is connected to a nut so that the left, right, top and bottom pivots are connected to the left, right, top and bottom holes.

* * * * *